US009562345B2

(12) United States Patent
Lee

(10) Patent No.: US 9,562,345 B2
(45) Date of Patent: Feb. 7, 2017

(54) DRIVING CONTROL METHOD FOR CONSTRUCTION MACHINE

(75) Inventor: Chun-Han Lee, Gimhae-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 235 days.

(21) Appl. No.: 14/403,945

(22) PCT Filed: Jun. 4, 2012

(86) PCT No.: PCT/KR2012/004378

§ 371 (c)(1),
(2), (4) Date: Nov. 25, 2014

(87) PCT Pub. No.: WO2013/183795

PCT Pub. Date: Dec. 12, 2013

(65) Prior Publication Data

US 2015/0176251 A1 Jun. 25, 2015

(51) Int. Cl.
*E02F 9/22* (2006.01)
*E02F 9/26* (2006.01)
(Continued)

(52) U.S. Cl.
CPC ..... *E02F 9/2242* (2013.01); *E02F 9/2253* (2013.01); *E02F 9/2292* (2013.01); *E02F 9/26* (2013.01);
(Continued)

(58) Field of Classification Search
CPC ..... E02F 9/2242; E02F 9/2253; E02F 9/2292; E02F 9/26; F15B 2211/6346; F15B 11/17; F15B 21/10
See application file for complete search history.

(56) References Cited

U.S. PATENT DOCUMENTS 7,614,225 B2 11/2009 Kim
8,532,888 B2 * 9/2013 Ishibashi ..... E02F 9/202 477/110
(Continued)

FOREIGN PATENT DOCUMENTS

JP H07-026592 A 1/1995
JP H07-207697 A 8/1995
(Continued)

OTHER PUBLICATIONS

International Search Report (in Korean and English) and Written Opinion (in Korean) for PCT/KR2012/004378, mailed Feb. 14, 2013; ISA/KR.

*Primary Examiner* — Thomas E Lazo
(74) *Attorney, Agent, or Firm* — Harness, Dickey & Pierce, P.L.C.

(57) ABSTRACT

A traveling control method for performing a smoothing work or the like through an operation of a working device during traveling is provided. The traveling control method includes a first step of inputting a set value of a delay time of a traveling switching function of a traveling switching valve; a second step of inputting in real time an operation signal value according to a user's operation of a joystick and a traveling pedal; a third step of determining whether to operate the traveling and working devices according to the operation of the traveling pedal and the joystick; a fourth step of switching the traveling switching valve to a traveling switching mode through control of the electronic valve and returning to the second step when the traveling pedal and the joystick are simultaneously operated; a fifth step of determining whether the traveling pedal is operated and the operation of the joystick is temporarily stopped for a predetermined time; a sixth step of determining whether the set value of the delay time of the traveling switching function is larger than an initially set time required and switching the
(Continued)

traveling switching valve to the traveling switching mode if the set value is relatively larger than the initially set time; and a seventh step of releasing the traveling switching mode of the traveling switching valve through control of the electronic valve and returning to the second step in the case where the traveling pedal is not initially operated, in the case where the traveling pedal is operated and the joystick operation has been stopped over the predetermined time, or in the case where the initially set time required is larger than the set value of the delay time.

8 Claims, 4 Drawing Sheets

(51) Int. Cl.
*F15B 11/17* (2006.01)
*F15B 21/10* (2006.01)

(52) U.S. Cl.
CPC ..... *F15B 11/17* (2013.01); *F15B 21/10* (2013.01); *F15B 2211/6346* (2013.01)

(56) References Cited

U.S. PATENT DOCUMENTS

| | | | | |
|---|---|---|---|---|
| 9,008,919 | B2 * | 4/2015 | Lee | E02F 9/2033 172/2 |
| 9,145,657 | B2 * | 9/2015 | Lee | E02F 3/437 |
| 9,182,312 | B2 * | 11/2015 | Kim | E02F 9/2025 |
| 2007/0240562 | A1 | 10/2007 | Kim | |
| 2013/0090771 | A1 | 4/2013 | Kim et al. | |
| 2013/0116897 | A1 | 5/2013 | Lee et al. | |
| 2013/0269332 | A1 | 10/2013 | Suk et al. | |
| 2014/0150416 | A1 | 6/2014 | Lee | |
| 2014/0158235 | A1 | 6/2014 | Suk et al. | |
| 2014/0174071 | A1 | 6/2014 | Lee | |
| 2014/0244118 | A1 | 8/2014 | Lee | |

FOREIGN PATENT DOCUMENTS

| | | | |
|---|---|---|---|
| JP | 2010-216208 | A | 9/2010 |
| KR | 10-0734442 | B1 | 7/2007 |
| KR | 10-2010-0071501 | A | 6/2010 |

* cited by examiner

DRIVING CONTROL METHOD FOR CONSTRUCTION MACHINE

TECHNICAL FIELD

The present invention relates to a traveling control method for a construction machine. More particularly, the present invention relates to a traveling control method for a construction machine, which can improve operability of a working device such as an arm when a smoothing work is performed through simultaneous operation of traveling and working devices during traveling of an excavator.

BACKGROUND ART

A traveling control system for a construction machine in the related art, as illustrated in FIGS. 1A and 1B, includes first and second hydraulic pumps P1 and P2, connected to an engine (not illustrated), a left traveling control valve 2 installed in a discharge flow path 1 of the first hydraulic pump P1 to control driving of a left traveling motor, a first working device control valve 3 installed in a parallel flow path 1*a* of the first hydraulic pump P1 and composed of spools that control driving of a first arm and a second boom, respectively, a right traveling control valve 5 installed in a discharge flow path 4 of the second hydraulic pump P2 to control driving of a right traveling motor, a second working device control valve 7 installed in a parallel flow path 4*a* of the second hydraulic pump P2 and composed of spools that control driving of a first boom, a bucket, and a second arm, respectively, a traveling switching valve 8 installed in the parallel flow path 1*a* of the first hydraulic pump P2 and the discharge flow path 4 of the second hydraulic pump P2 and switched to distribute and supply hydraulic fluid from the first hydraulic pump P1 to the left traveling motor and the right traveling motor and to distribute and supply hydraulic fluid from the second hydraulic pump P2 to the first working device control valve 3 and the second working device control valve 7 so as to prevent eccentric traveling, and an electronic valve 9 switching the traveling switching valve 8 to a traveling switching mode during a combined operation in which traveling and working devices are simultaneously operated.

As illustrated in FIG. 2, in the case of performing inlay work for smoothing the ground or carrying heavy objects using an excavator, an operator simultaneously operates a working device 10, such as a boom or an arm, and a traveling device (indicated as a track in the drawing) 6.

That is, in the case where the operator operates the working device 10 through an operation of a joystick and simultaneously operates the traveling device 6 through an operation of a traveling pedal to perform inlay work, the traveling switching valve 8 is switched to a traveling switching mode (spool is shifted to the position of FIG. 1B) by the electronic valve 9. Through this, hydraulic fluid that is discharged from the first hydraulic pump P1 is distributed and supplied to the left traveling motor and the right traveling motor through the discharge flow paths 1 and 4, and hydraulic fluid that is discharged from the second hydraulic pump P2 is distributed and supplied to the first working device control valve 3 and the second working device control valve 7 through the parallel flow paths 1*a* and 4*a*.

Accordingly, in the case of performing the smoothing work through simultaneous operation of the working device during traveling, eccentric traveling of the equipment can be prevented.

On the other hand, if the operation of the working device 10 such as an arm is instantaneously stopped (as an example, if an arm-out operation is performed for the smoothing work after an arm-in operation) in the case of the simultaneous operation of the working device 10 during the traveling (indicated as rightward traveling in FIG. 2), the traveling switching mode function of the traveling switching valve 8 is released.

As described above, since the traveling switching mode function of the traveling switching valve 8 is released (spool is shifted to the position of FIG. 1A) at a moment when the operation direction of the working device such as an arm is changed during the traveling of the excavator, shock occurs when the working device 10 is operated, and this may cause operator's fatigue to be increased and operability of the working device 10 to deteriorate.

DISCLOSURE

Technical Problem

Therefore, the present invention has been made to solve the above-mentioned problems occurring in the related art, and one embodiment of the present invention is related to a traveling control method for a construction machine, which can improve operability of a working device through delay of a release function of a traveling switching mode for a predetermined time if the working device is not temporarily operated during a combined operation in which the working device is simultaneously operated during traveling of the excavator.

Technical Solution

In accordance with an aspect of the present invention, there is provided a traveling control method for a construction machine including first and second hydraulic pumps, a left traveling control valve installed in a discharge flow path of the first hydraulic pump, a right traveling control valve installed in a discharge flow path of the second hydraulic pump, a first working device control valve installed in a parallel flow path of the first hydraulic pump, a second working device control valve installed in a parallel flow path of the second hydraulic pump, a traveling switching valve switched when traveling and working devices are simultaneously operated to distribute and supply hydraulic fluid from the first hydraulic pump to a left traveling motor and a right traveling motor and to distribute and supply hydraulic fluid from the second hydraulic pump to the first working device control valve and the second working device control valve so as to prevent eccentric traveling, an electronic valve switching the traveling switching valve, and a controller controlling the electronic valve, the traveling control method including a first step of inputting a set value of a delay time of a traveling switching function of the traveling switching valve; a second step of inputting in real time an operation signal value according to a user's operation of a joystick and a traveling pedal; a third step of determining whether to operate the traveling and working devices according to the operation of the traveling pedal and the joystick; a fourth step of switching the traveling switching valve to a traveling switching mode through control of the electronic valve and returning to the second step repeatedly when the traveling pedal and the joystick are simultaneously operated; a fifth step of determining whether the traveling pedal is operated and the operation of the joystick is temporarily stopped for a predetermined time; a sixth step of determining whether the set value of the delay time of the traveling switching function is larger than an initially set time required and switching the traveling switching valve to the traveling switching mode if the set value is relatively larger than the initially set time; and a seventh step of releasing the traveling switching mode of the traveling switching valve through control of the electronic valve and repeating returning to the second step in the case where the traveling pedal is not initially operated, in the case where the traveling pedal is operated and the joystick operation has been stopped over the predetermined time, or in the case where the initially set time required is larger than the set value of the delay time.

Preferably, an output voltage that is input to the controller according to the operation of an electric joystick may be used as a detection means for detecting whether the traveling and working devices are operated.

Secondary pressure that is input to the controller according to the operation of a hydraulic joystick may be used as a detection means for detecting whether the traveling and working devices are operated.

A hydraulic switch provided in a hydraulic system may be used as a detection means for detecting whether the traveling and working devices are operated.

A parameter stored in an internal memory provided in the controller may be used as a means for inputting the set value to the controller.

A switch that can be set by a user may be used as a means for inputting the set value to the controller.

A monitor installed in a cab may be used as a means for inputting the set value to the controller.

A cluster installed in a cab may be used as a means for inputting the set value to the controller.

Advantageous Effect

The traveling control method for a construction machine as configured above according to the aspect of the present invention has the following advantages.

Even if the working device is not temporarily operated during traveling when the smoothing work is performed using the excavator, the traveling switching mode function is controlled not to be released for the predetermined time, and thus shock occurrence is decreased during the operation of the working device to improve operability.

BRIEF DESCRIPTION OF THE DRAWINGS

The above objects, other features and advantages of the present invention will become more apparent by describing the preferred embodiments thereof with reference to the accompanying drawings, in which.

DESCRIPTION OF REFERENCE NUMERALS IN THE DRAWING

Figure 1A:
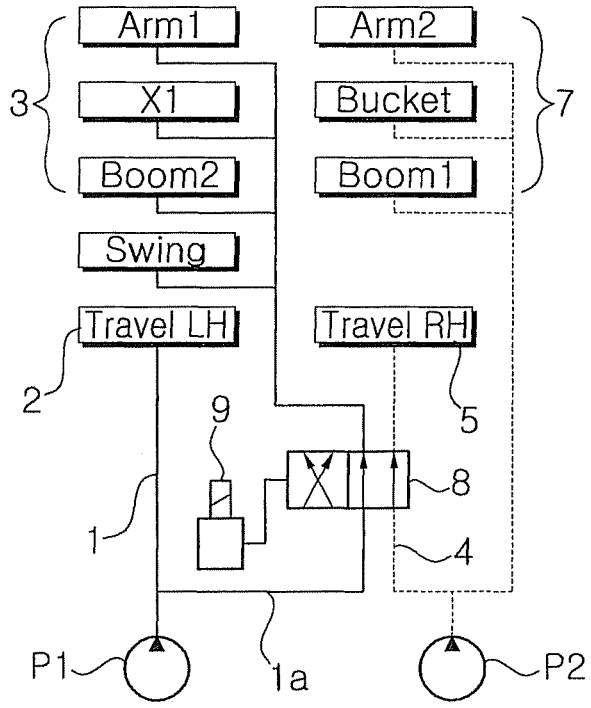
FIGS. 1A and 1B are diagrams explaining a traveling control device in the related art.

8: traveling switching valve
9: electronic valve
10: working device
11: controller
12: joystick
13: traveling pedal
14: cluster

BEST MODE

Hereinafter, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 3:
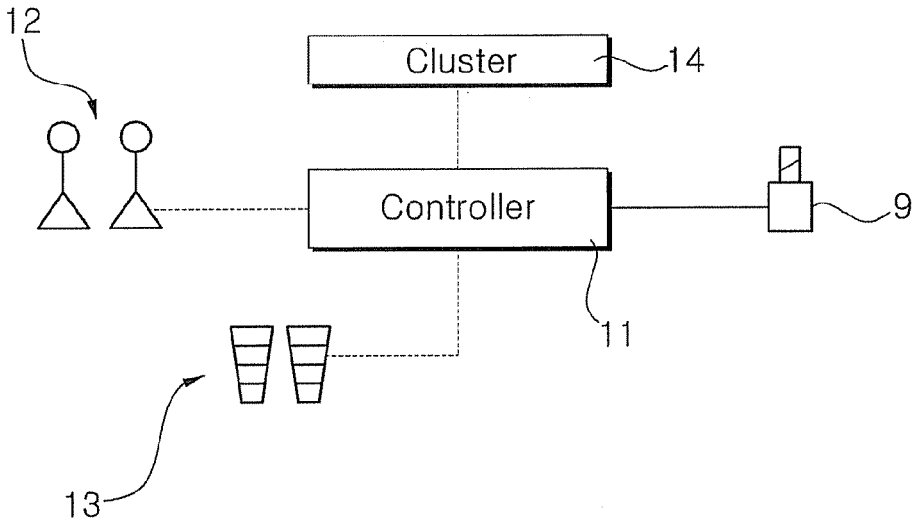
FIG. 3 is a diagram explaining an electronic valve control for traveling switching according to an operation of traveling and working devices in a traveling control method for a construction machine according to an embodiment of the present invention.
Figure 4:
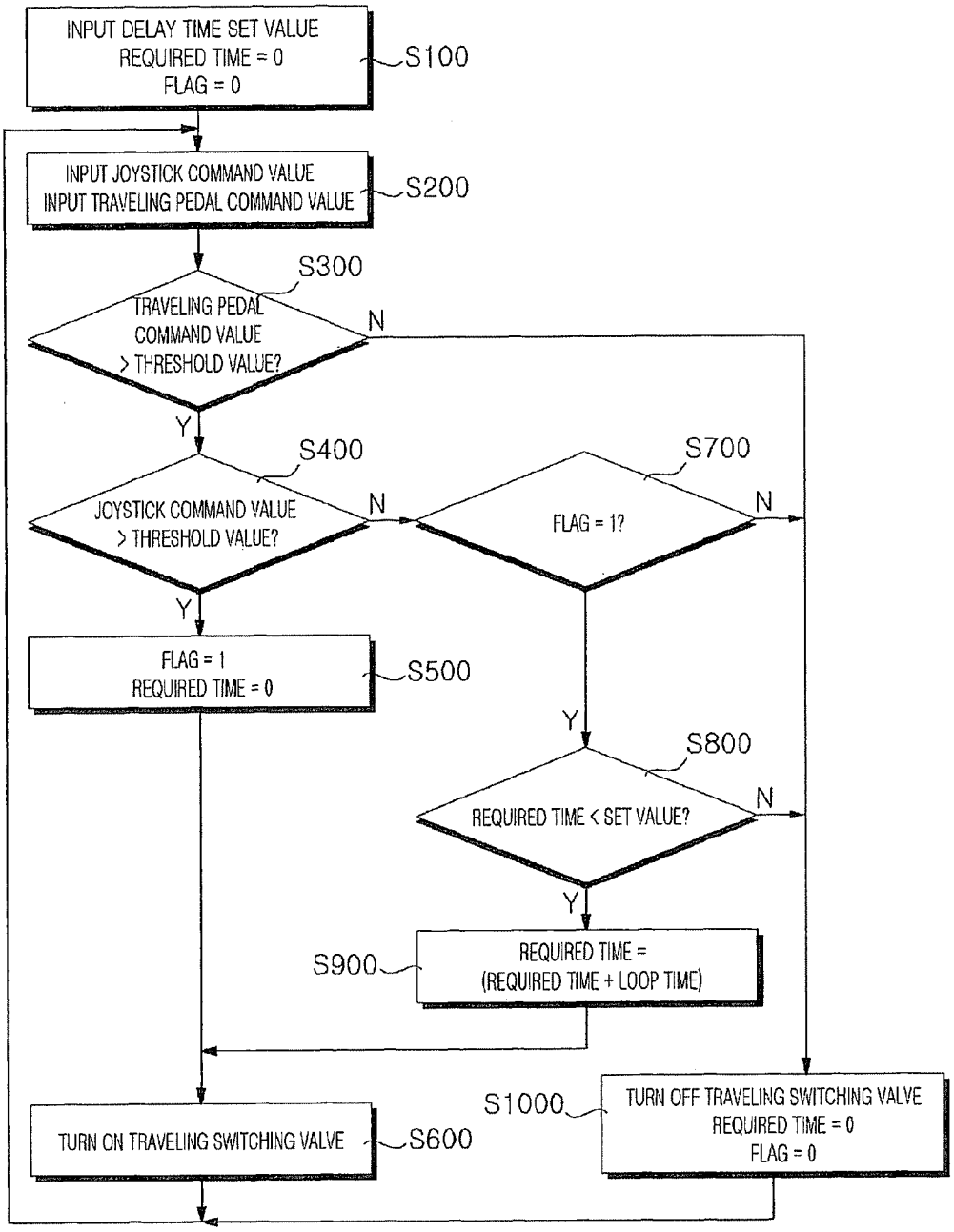
FIG. 4 is a flowchart illustrating a traveling control method for a construction machine according to an embodiment of the present invention.

As illustrated in FIGS. 3 and 4, a traveling control method for a construction machine according to an embodiment of the present invention, including first and second hydraulic pumps P1 and P2, connected to an engine (not illustrated), a left traveling control valve 2 installed in a discharge flow path 1 of the first hydraulic pump P1 to control driving of a left traveling motor, a right traveling control valve 5 installed in a discharge flow path 4 of the second hydraulic pump P2 to control driving of a right traveling motor, a first working device control valve 3 installed in a parallel flow path 1*a* of the first hydraulic pump P1 and composed of spools that control driving of a first arm and a second boom, respectively, a second working device control valve 7 installed in a parallel flow path 4*a* of the second hydraulic pump P2 and composed of spools that control driving of a first boom, a bucket, and a second arm, respectively, a traveling switching valve 8 switched when traveling and working devices are simultaneously operated to distribute and supply hydraulic fluid from the first hydraulic pump P1 to the left traveling motor and the right traveling motor and to distribute and supply hydraulic fluid from the second hydraulic pump P2 to the first working device control valve 3 and the second working device control valve 7 so as to prevent eccentric traveling, an electronic valve 9 switching the traveling switching valve 8, and a controller 11 controlling the electronic valve 9, includes a first step (S100) of inputting a set value of a delay time of a traveling switching function of the traveling switching valve 8 and setting initial values of a required time and a flag to "0"; a second step (S200) of inputting in real time operation signal values according to a user's operation of a joystick 12 and a traveling pedal 13; a third step (S300) of comparing the operation signal value according to the operation of the traveling pedal 13 with a set value (a threshold value preset to determine whether the traveling pedal 13 is operated), and determining that the traveling pedal 13 is operated to perform traveling if the operation signal value is relatively larger than the set value; a fourth step (S400) of comparing the operation signal value according to the operation of the joystick 12 with a set value (a threshold value preset to determine whether the joystick 12 is operated), and determining that the joystick 12 is operated to operate the working device if the operation signal value is relatively larger than the set value; a fifth step (S500) of storing "0" as the required time and "1" as the flag in the controller 11 if it is determined that the traveling pedal 13 and the joystick 12 are simultaneously operated; a sixth step (S600) of switching the traveling switching valve 8 to a traveling switching mode through control of the electronic valve 9 and returning to the second step (S200) repeatedly in the case where the traveling pedal 13 and the joystick 12 are simultaneously operated; a seventh step (S700) of determining whether the flag is "1" (flag=1?) if the traveling pedal 13 is operated and the operation of the joystick 12 is temporarily stopped for a predetermined time; an eighth step (S800) of determining whether an initially set time required (e.g., set to "required time=0") is larger than a delay time set value (e.g., set to "1" second); a ninth step (S900) of proceeding to the sixth step (S600) to switch the traveling switching valve 8 to the traveling switching mode if the set value is larger than the required time value (required time+loop time (incremental value of a time required for a program to operate by one loop for measurement of the required time); a tenth step (S1000) of releasing the traveling switching mode of the traveling switching valve 8 through control of the electronic valve 9 and returning to the second step (S200) repeatedly if the traveling pedal 13 is not initially operated, if the traveling pedal 13 is operated and the operation of the joystick 12 is stopped over a predetermined time, or if the initially set time required is larger than the delay time set value.

As a detection means for detecting whether the traveling and working devices are operated, an output voltage that is input to the controller 11 according to the operation of an electric joystick 12 may be used.

As detection means for detecting whether the traveling and working devices are operated, a secondary pressure that is input to the controller 11 according to the operation of a hydraulic joystick 12 may be used.

As a detection means for detecting whether the traveling and working devices are operated, a hydraulic switch provided in a hydraulic system may be used.

As a means for inputting the set value to the controller 11, a parameter stored in an internal memory provided in the controller 11 may be used.

As a means for inputting the set value to the controller 11, a switch that can be set by a user may be used.

As a means for inputting the set value to the controller 11, a monitor installed in a cab may be used.

As a means for inputting the set value to the controller 11, a cluster 14 installed in a cab may be used.

Hereinafter, a use example of a traveling control method for a construction machine according to an embodiment of the present invention will be described in detail with reference to the accompanying drawings.

The excavator as described above includes a traveling device, an upper swing structure mounted on the traveling device to swing, and working devices, such as a boom, an arm, and a bucket, rotatably mounted on the upper swing structure.

In the case of performing inlay work for smoothing the ground using the excavator as in the step (S100) of FIGS. 3 and 4, a user inputs the delay time set value (e.g., set to "set value=1") of the traveling switching function of the traveling switching valve 8 to the controller 11, and sets initial values of the required time and the flag to "0".

The set value as described above is a value that is set as a time t for delaying the release of the traveling switching mode on condition that the traveling switching mode of the traveling switching valve 8 is released.

As in the step (S200), the user inputs in real time the operation signal values according to the operation of the joystick 12 and the traveling pedal 13 to the controller 11.

As in the step (S300), the operation signal value according to the operation of the traveling pedal 13 is compared with the set value. If the operation signal value is relatively larger than the set value, it is determined that the traveling pedal 13 is operated to proceed to the step (S400), while if the operation signal value is relatively smaller than the set value, it is determined that the traveling pedal 13 is not operated to proceed to the step (S1000).

As in the step (S400), the operation signal value according to the operation of the joystick 12 is compared with the set value. If the operation signal value is relatively larger than the set value, it is determined that the joystick 12 is operated to proceed to the step (S500), while if the operation signal value is relatively smaller than the set value, it is determined that the joystick 12 is not operated to proceed to the step (S700).

As in the step (S500), if it is determined that the traveling pedal 13 and the joystick 12 are simultaneously operated, "0" is stored as the required time and "1" is stored as the flag in the controller 11.

As in the step (S600), if it is determined that the traveling pedal 13 and the joystick 12 are simultaneously operated, the traveling switching valve 8 is switched to the traveling switching mode through the control of the electronic valve 9 to return to the second step (S200) repeatedly.

As in the step (S700), it is recognized that the traveling pedal 13 is operated, and it if determined whether the operation of the joystick 12 is temporarily stopped for the predetermined time (i.e., if the operation of the working device is temporarily stopped during the traveling). If it is determined that the traveling pedal 13 is operated and the operation of the joystick 12 is temporarily stopped within the predetermined time, the step proceeds to the step (S800), while if it is determined that the traveling pedal 13 is operated and the operation of the joystick 12 is temporarily stopped over the predetermined time, the step proceeds to the step (S1000).

As in the step (S800), it is determined whether the initially set time required (e.g., set to "0") is larger than the delay time set value (e.g., may be set to "1" second). If the delay time set value is larger than the required time, the step proceeds to the step (S900), while if the delay time set value is smaller than the required time, the step proceeds to the step (S1000).

As in the step (S900), the step proceeds to the sixth step (S600) so as to switch the traveling switching valve 8 to the traveling switching mode if the set value is larger than the required time value (required time+loop time (incremental value of a time required for a program to operate by one loop for measurement of the required time) in the eighth step (S800).

Figure 1B:
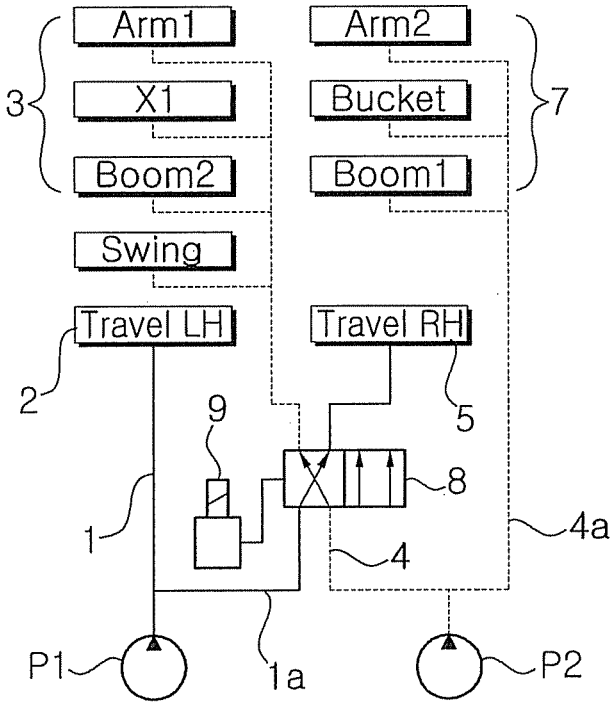
Figure 2:
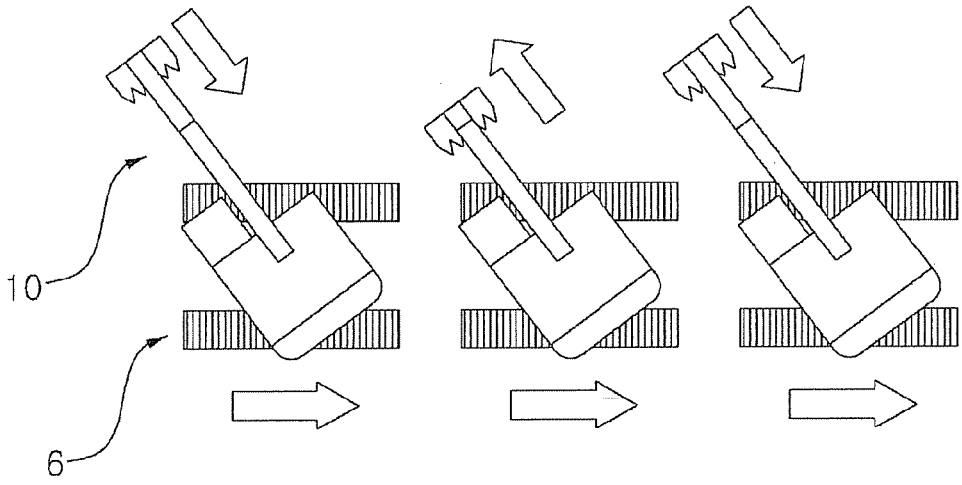
FIG. 2 is a view explaining an inlay work that is performed by driving a working device during traveling.

That is, if the delay time set value of the traveling switching function is set to "1" second, the release of the traveling switching mode is delayed for the predetermined time (i.e., one second) even if the working device operation signal is not input within the predetermined time in a state where the traveling switching valve 8 is switched to the traveling switching mode (i.e., the spool is shifted to the position of FIG. 1B). Through this, in the case where the operation of the working device is temporarily stopped for the predetermined time during the combined operation in which the traveling and working devices are simultaneously operated, the traveling switching function is maintained for the predetermined time, and thus the operability of the working device can be improved.

As in the step (S1000), the traveling switching mode of the traveling switching valve 8 is released through the control of the electronic valve 9 (i.e., the spool is shifted to the position of FIG. 1A), and the step returns to the second step (S200) repeatedly if the traveling pedal 13 is not initially operated (i.e., if only the working device or the swing device is operated in a state where the operation of the equipment is stopped), if the traveling pedal 13 is operated and the operation of the joystick 12 is stopped over the predetermined time, or if the initially set time required is larger than the delay time set value.

INDUSTRIAL APPLICABILITY

As apparent from the above description, according to the present invention having the above-described configuration, operability of the working device can be improved through the delay of the release function of the traveling switching mode for the predetermined time if the working device is not temporarily operated during the combined operation in which the working device is simultaneously operated during the traveling of the excavator.

The invention claimed is:

1. A traveling control method for a construction machine including first and second hydraulic pumps, a left traveling control valve installed in a discharge flow path of the first hydraulic pump, a right traveling control valve installed in a discharge flow path of the second hydraulic pump, a first working device control valve installed in a parallel flow path of the first hydraulic pump, a second working device control valve installed in a parallel flow path of the second hydraulic pump, a traveling switching valve switched when traveling and working devices are simultaneously operated to distribute and supply hydraulic fluid from the first hydraulic pump to a left traveling motor and a right traveling motor and to distribute and supply hydraulic fluid from the second hydraulic pump to the first working device control valve and the second working device control valve so as to prevent eccentric traveling, an electronic valve switching the traveling switching valve, and a controller controlling the electronic valve, the traveling control method comprising:

a first step of inputting a set value of a delay time of a traveling switching function of the traveling switching valve;

a second step of inputting in real time an operation signal value according to a user's operation of a joystick and a traveling pedal;

a third step of determining whether to operate the traveling and working devices according to the operation of the traveling pedal and the joystick;

a fourth step of switching the traveling switching valve to a traveling switching mode through control of the electronic valve and returning to the second step repeatedly when the traveling pedal and the joystick are simultaneously operated;

a fifth step of determining whether the traveling pedal is operated and the operation of the joystick is temporarily stopped for a predetermined time;

a sixth step of determining whether the set value of the delay time of the traveling switching function is larger than an initially set time required and switching the traveling switching valve to the traveling switching mode if the set value is relatively larger than the initially set time; and a seventh step of releasing the traveling switching mode of the traveling switching valve through control of the electronic valve and repeating returning to the second step in the case where the traveling pedal is not initially operated, in the case where the traveling pedal is operated and the joystick operation has been stopped over the predetermined time, or in the case where the initially set time required is larger than the set value of the delay time.

2. The traveling control method according to claim 1, wherein an output voltage that is input to the controller according to the operation of an electric joystick is used as a detection means for detecting whether the traveling and working devices are operated.

3. The traveling control method according to claim 1, wherein secondary pressure that is input to the controller according to the operation of a hydraulic joystick is used as a detection means for detecting whether the traveling and working devices are operated.

4. The traveling control method according to claim 1, wherein a hydraulic switch provided in a hydraulic system is used as a detection means for detecting whether the traveling and working devices are operated.

5. The traveling control method according to claim 1, wherein a parameter stored in an internal memory provided in the controller is used as a means for inputting the set value to the controller.

6. The traveling control method according to claim 1, wherein a switch that can be set by a user is used as a means for inputting the set value to the controller.

7. The traveling control method according to claim 1, wherein a monitor installed in a cab is used as a means for inputting the set value to the controller.

8. The traveling control method according to claim 1, wherein a cluster installed in a cab is used as a means for inputting the set value to the controller.

* * * * *